US010729170B2

(12) United States Patent
Duggan

(10) Patent No.: US 10,729,170 B2
(45) Date of Patent: Aug. 4, 2020

(54) CIGARETTES AND THEIR CONSTRUCTION

(71) Applicant: Kerry Grant Duggan, Berserker (AU)

(72) Inventor: Kerry Grant Duggan, Berserker (AU)

( * ) Notice: Subject to any disclaimer, the term of this patent is extended or adjusted under 35 U.S.C. 154(b) by 0 days.

(21) Appl. No.: 14/780,371

(22) PCT Filed: Mar. 26, 2014

(86) PCT No.: PCT/AU2014/000358

§ 371 (c)(1),
(2) Date: Sep. 25, 2015

(87) PCT Pub. No.: WO2014/153622

PCT Pub. Date: Oct. 2, 2014

(65) Prior Publication Data

US 2016/0029692 A1 Feb. 4, 2016

(30) Foreign Application Priority Data

Mar. 27, 2013 (AU) ..... 2013901067
Apr. 12, 2013 (AU) ..... 2013204693

(51) Int. Cl.

| | |
|---|---|
| ***A24D 1/02*** | (2006.01) |
| ***A24D 1/10*** | (2006.01) |
| ***A24C 5/10*** | (2006.01) |
| ***A24C 5/47*** | (2006.01) |
| ***A24C 5/58*** | (2006.01) |

(52) U.S. Cl.

CPC ..... *A24D 1/025* (2013.01); *A24C 5/10* (2013.01); *A24C 5/47* (2013.01); *A24C 5/586* (2013.01); *A24D 1/10* (2013.01)

(58) Field of Classification Search
None
See application file for complete search history.

(56) References Cited

U.S. PATENT DOCUMENTS

| | | | |
|---|---|---|---|
| 3,102,543 | A | 9/1963 | O'Siel et al. |
| 3,800,805 | A | 4/1974 | Horsewell et al. |
| 4,474,192 | A | 10/1984 | MacLean et al. |
| 5,778,898 | A | 7/1998 | Bae et al. |
| 5,992,420 | A | 11/1999 | Moriyama |
| 2008/0029111 | A1 | 2/2008 | Dube et al. |

(Continued)

FOREIGN PATENT DOCUMENTS

| | | |
|---|---|---|
| CN | 2478371 | 2/2002 |
| CN | 2520682 | 11/2002 |
| FR | 2135382 | 12/1972 |

(Continued)

OTHER PUBLICATIONS

International Search Report for PCT/AU2014/000358, Completed by the Australian Patent Office on May 19, 2014, 8 Pages.

(Continued)

*Primary Examiner* — Michael H. Wilson
*Assistant Examiner* — Katherine A Will
(74) *Attorney, Agent, or Firm* — Brooks Kushman P.C.

(57) ABSTRACT

A cigarette is provided with the tobacco column portion adjacent the filter assembly encased by a heat shrink material whereby as the burn approaches the butt the heat shrink material begins to contract radially and compress the encased tobacco column restricting the air flow therethrough. This reduces the diameter of burning column adjacent the filter assembly and thus extinguishes or at least confines the remaining tobacco in the cigarette.

1 Claim, 2 Drawing Sheets

(56) References Cited

U.S. PATENT DOCUMENTS

2010/0294289 A1 11/2010 Dube et al.

FOREIGN PATENT DOCUMENTS

| | | |
|---|---|---|
| JP | S5828267 | 2/1983 |
| JP | 2000004865 | 1/2000 |

OTHER PUBLICATIONS

Crellin et al. Beitrage zur Tabakforschung (Contributions to Tobacco Research) 1975, vol. 8, p. 70-77, "The Control of Cigarette Smoke Deliveries Using Heat-Shrinkable Films".

Gunja et al. Tobacco Control 2002, vol. 11, p. 346-353, "The case for fire safe cigarettes made through industry documents".

Holleyhead, Science and Justice 1999, vol. 39, No. 2, p. 75-102, "Ignition of solid materials and furniture by lighted cigarettes. A review".

Extended European Search Report for European Application No. EP 14775887.4, Completed by the European Patent Office, dated Dec. 14, 2016, 5 Pages.

Japanese Search Report for Japanese Application No. JP 2016-504423, English translation attached to original, dated Jan. 24, 2018, All together 15 Pages.

CIGARETTES AND THEIR CONSTRUCTION

CROSS-REFERENCE TO RELATED APPLICATION

This application is the U.S. national phase of PCT Application No. PCT/AU2014/000358 filed on Mar. 26, 2014, which claims priority to AU Patent Application No. 2013901067 filed on Mar. 27, 2013 and AU Patent Application No. 2013204693 filed Apr. 12, 2013, the disclosures of which are incorporated in their entirety by reference herein.

TECHNICAL FIELD

This invention relates to cigarettes, their construction and components therefore.

BACKGROUND

The disposal of cigarettes by casting away burning cigarettes without thought of the consequences can and often does cause damage. This may range from a burn mark in a floor or its covering, a house fire or in the worst case a bush fire with sometimes dire consequences.

Cigarettes are most often smoked down to a short length whereupon they are discarded with the remnants of the tobacco column alight. As such, the discarded butt constitutes a fire hazard. Many conscientious smokers stamp on the burning butt to extinguish it, while others may simply throw the burning butt aside without thought of the possible consequences. As a result, the haphazard disposal of cigarettes constitutes a significant damage threat to property and people.

Another frequent occurrence is damage to furniture by placing a burning butt onto the surface of a piece of furniture. While such damage may often be only superficial it may significantly degrade the value of the burnt article which may, as a result of the burn require costly repairs.

This invention aims to reduce the potential for damage being caused to property and people by improperly discarded cigarettes. This invention further aims to provide cigarettes which, even when disposed of haphazardly as a burning butt, will self-extinguish so as to minimise the risk of setting alight a flammable medium into or onto which the burning butt is discarded.

Many smokers only rarely discard cigarettes when the tobacco column is completely burnt away, leaving only the filter. While the reason for this is not known by the applicant it is possible that the unburnt tobacco column remaining behind the burning end acts as a preliminary filter of the nicotine laden smoke with the result that the nicotine content of the smoke gradually increases during smoking. As a result the taste of the smoke becomes sufficiently unpleasant and, probably subconsciously at that stage, the cigarette is discarded as a burning butt. This results in the disposal of cigarettes which remain alight and thus have the potential to cause significant damage.

There have been studies conducted which suggest that much of the undesirable smoke pollutants which are puffed from a cigarette are inhaled during puffing the near end of the tobacco column. Thus any means which limits the smoke inhalation during the burn of the tobacco column at the filter end has the potential to reduce inhalation of some pollutants from a cigarette.

A typical packet cigarette is made from a column of tobacco wrapped in cigarette paper and joined to a filter plug by the wrap of tipping paper which overlaps a portion of the butt of the tobacco column, the filter plug medium itself being wrapped in a plug wrap. All of these components are assembled to form the particular property of a cigarette which is enjoyed by a smoker and a vast amount of money is spent promoting respective brands and types each having a particular characteristic determined by the mix of factors of each element utilised in the construction of cigarettes.

This invention aims to provide improvements to cigarettes, components therefore and methods of manufacture which will alleviate at least one of the abovementioned disadvantages.

SUMMARY OF INVENTION

With the foregoing in view, this invention in one aspect resides in a cigarette having its tobacco column butt portion encased by a shrinkable material which shrinks upon the application of heat thereto whereby as the burning end of the cigarette approaches the butt the shrinkable material begins to contract and compress the encased tobacco column restricting the air flow therethrough.

Typically if a tobacco column in a cigarette rod has a length of about 50 mm, the heat shrinkable material would extend along the butt portion thereof adjacent the filter for about 6 mm to 10 mm although this may be varied as desired. The tobacco column may be configured so that in use, shrinking of the encasing material will provide a relatively sudden change in the smoking characteristic of the cigarette when the burn reaches the heat shrinkable material. This may cause the smoker to discard the cigarette at that stage of the burn at which substantially all the remaining unburnt tobacco will be confined within the encasing shrinkable material whereby it is made safer than a conventional cigarette for careless discarding. This cause for disposal of the cigarette may result from the cigarette becoming unpleasant to smoke or from a noticeable change in a smoking characteristic of the cigarette indicating to the smoker that concentrations of smoke pollutants are increasing.

The heat shrinkable material when heated by the adjacent burning tobacco may sufficiently compress the remaining tobacco column so as to confine it or deprive it of an air flow therethrough whereby it rapidly extinguishes.

The heat shrinkable encasing material may extend further along the column of tobacco and be arranged, such as by varying the thickness of the shrinkable material or its shrink properties, to shrink progressively or stepwise to reduce the air flow capacity through the cigarette as it is smoked and as a consequence provide a condition which may reduce the rate of smoke and nicotine intake when puffing on the reduced airflow portion of the cigarette or cause the smoker to discard the cigarette before the burn reaches the butt of the tobacco column. Such an arrangement has the potential to reduce nicotine or other pollutants derived from smoking a cigarette.

The encasing shrinkable material may be provided for the purpose of reducing the column diameter of the cigarette rod adjacent the burn to such extent that damage caused by placing a burning cigarette butt onto a flat surface will be prevented or reduced, as the heat shrinkable material will cause the burning portion of the rod to shrink away from the supporting surface whilst being supported by the filter assembly resting on the surface.

If desired, along with the selection of characteristics of the heat shrinkable material, the density or configuration of the tobacco column may be varied, such as by its density being reduced or increased in the area encased by the shrinkable material to achieve a desired result. Thus for example, the density may be reduced to achieve the desired degree of necking of the still burning portion of the tobacco column or the density may be increased to assist the necking result caused by shrinking of the encasing material to compressing the tobacco column sufficiently to extinguish the encased tobacco or to achieve a desired pre-filtering effect.

Many heat shrinkable materials are available both in tube form and in sheet or tape form and many are used in confined areas such that shrinkable material has been developed to make the fumes resultant from the heat shrink process non-toxic or at least sufficiently safe for human consumption and only such materials which are safe for use in this application would be selected for use in the present invention. However the use of a shrinkable material with a specific taste may provide a further signal to a smoker that for least harm to the smoker, the cigarette should be discarded at the point where the encasing material commences to react to the heat of the burning tobacco column.

The encasing shrinkable material may be applied to the cigarette in the form of a tube or it may be applied in the form of a wrap. Alternatively the shrinkable material may be applied as a spray-on layer or as a liquid which dries to form the encasing layer.

In a preferred form the shrinkable material is applied as a tape during the cigarette forming process and it may be utilised to secure the tobacco column to the filter assembly. In one form the shrinkable material is formed as a tape combined with the tipping paper whereby it may be supplied to the cigarette manufacture as a substitute tipping paper so as to minimise manufacturing process changes in the manufacture of cigarettes.

Accordingly, in another aspect this invention resides in a tipping wrap including a layer or band of shrinkable material protruding from an edge of a band of tipping paper. This forms a composite band of the heat shrinkable material and tipping paper which may be wrapped around the filter and the tobacco column to connect them together and/or to form a tube of heat shrinkable material extending along the butt of the tobacco column.

For this purpose the tipping paper may be of conventional size and the shrinkable material may be laminated to the portion of the tipping paper which normally overlaps the tobacco column. Alternatively the width of the tipping paper may be reduced and the shrinkable material may overlap all or a significant portion of the tipping paper and be apertured along the overlapping area to enable the tipping paper to pass air, smoke or gases therethrough.

The shrinkable material may be formed to extend only along one side of the tipping paper and be utilised to be wound onto a single tobacco column and filter assembly. Alternatively, the tipping paper of this invention may also be formed with shrinkable material extending along both sides of the tipping paper so as to permit the tipping paper to be wound onto opposed co-axial filter and tobacco columns in a process where the filters and tobacco columns are formed in joined co-axial pairs of cigarettes prior to separation between the adjacent filters.

This invention also resides in the methods of forming cigarettes as variously described above.

BRIEF DESCRIPTION OF THE DRAWINGS

In order that this invention may be more readily understood and put into practical effect, reference will now be made to the accompanying drawings which illustrate typical embodiments of cigarettes made by the methods and or utilising the components broadly described above, and wherein.

DESCRIPTION OF EMBODIMENTS

Figure 1:
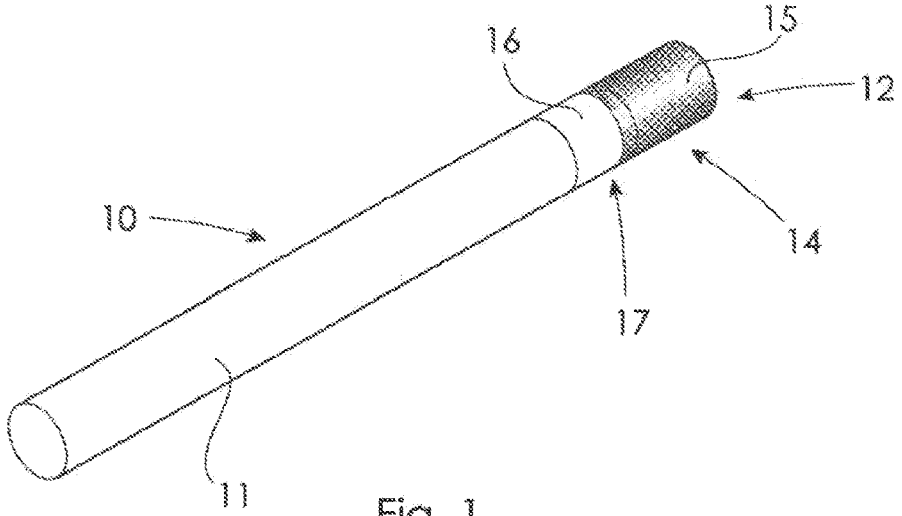
FIG. 1 is a perspective view of a cigarette formed according to one aspect of this invention.

Referring to FIG. 1 it will be seen that a cigarette 10 includes a wrapped tobacco column 11 secured to a filter assembly 12 by tipping paper 14 which is wrapped around the assembled filter assembly 12 and tobacco column 11 during a typical manufacturing process to join them together and to provide the filter wrap or tipping paper a smoker's lips contact.

Figure 2:
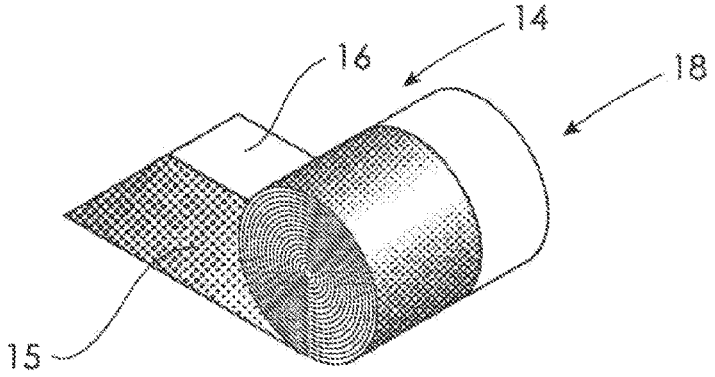
FIG. 2 illustrates a tipping paper made in accordance with one aspect of this invention.
Figure 3:
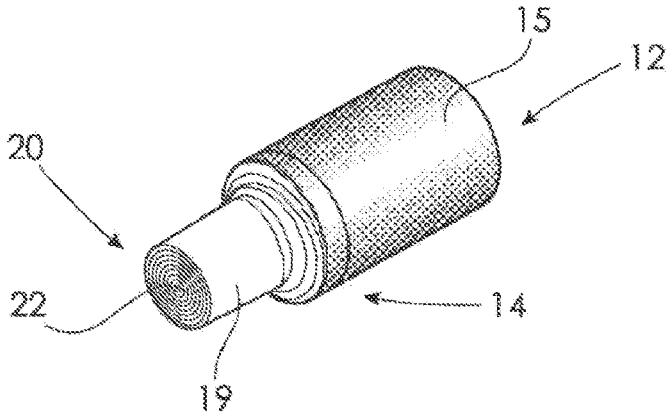
FIG. 3 illustrates the configuration of a discarded butt of a cigarette made in accordance with the embodiment of FIG. 1.

According to this invention, in this embodiment the tipping wrap 18, as illustrated in FIG. 2, includes a conventional tipping paper portion 15 and an adjoining wrapping portion 16 formed from heat shrinkable material which when wrapped upon itself about the tobacco column 11 forms an encasing tube which shrinks upon the application of heat thereto to a smaller diameter tube 19, as illustrated in FIG. 3, surrounding the unburnt tobacco and/or the ash from the burnt tobacco. For this purpose the heat shrinkable material is applied to the tipping paper with its major shrinking axis extending parallel to its junction with the tipping paper 15.

The width of the tipping paper portion 15 is suitably about the same as the length of the filter assembly 12 while the shrinkable wrapping portion 16 is sufficiently wide so as to extend along the butt portion 17 of a tobacco column which is normally discarded with the filter assembly 12. For a cigarette having a tobacco column diameter in the order of 7 mm to 9 mm the shrinkable wrapping portion 16 suitably has a length of between 6 mm to 12 mm. Suitably the shrinkable wrapping portion 16 is transparent but it may be of any desired colour and it may be printed with information desired to be displayed by the cigarette manufacturer.

As illustrated in FIG. 2, the tipping wrap 18 is supplied as a continuous roll 18 which may be wrapped around a former if desired or otherwise stored to enable it to be used as a substitute for the existing tipping paper so as to minimise disruption to the manufacturing process in order to incorporate aspects of this invention into the manufacture of cigarettes.

When a cigarette 10 according to this embodiment is smoked down to its butt 17, the core heat generated by the burning tobacco will cause the encasing heat shrinkable wrap of the wrapping portion 16 to shrink as a contracting tube 19, reducing the area of the open end 20 thereof, as illustrated in FIG. 3, through which air and pollutants may be drawn through the filter assembly 12 by the smoker.

Depending on the selection of the properties of the heat shrinkable material utilised in the wrapping portion 16, the reacting heat shrinkable material will either render the cigarette unpleasant for further smoking such that much of the pollutants contained in a tobacco column will not be inhaled, or the remaining tobacco burning with a diminished supply of oxygen or extinguished as a result of sufficient compaction of the tobacco within the shrunk tube 19 will be contained within the wrap 16 and rendered relatively harmless. Thus if discarded carelessly whilst alight into combustible material such as grass the butt should not cause a fire as many combustible materials have to be heated to an elevated temperature before combustion occurs. This requires the butt to remain alight for a relatively long period which should not occur in a cigarette according to this invention.

Further as illustrated in FIG. 3, a still burning butt in this form when rested on its side upon a flat surface such as a table will be disposed with its burning end 22 elevated above the table so that it will not heat the surface sufficiently to burn it.

Figure 4:
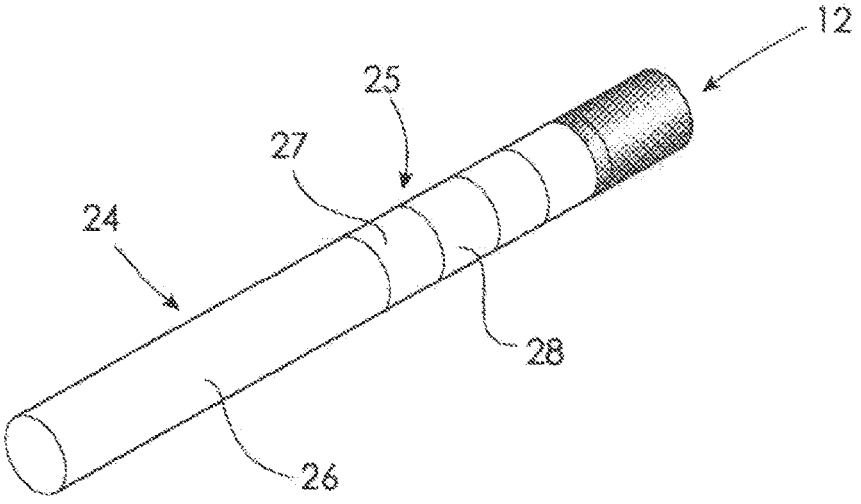
FIG. 4 is a perspective view of a cigarette formed according to another aspect of this invention.

In the cigarette 24 illustrated in FIG. 4, the heat shrinkable encasement 25 of the tobacco column 26 extends further along the column than in the cigarette illustrated in FIG. 1. Furthermore, this encasing tube 25 is graduated so that an outer portion, such as the end portion 27, will not shrink as much as the adjacent portion 28 whereby during smoking, the encasing tube 25 will progressively reduce in diameter to constrict and contain the burnt and burning tobacco column and if desired eventually extinguish the butt portion by sufficient compression of the tobacco column to effectively prevent the through flow of air necessary to maintain burning.

The encasing tube 25 could extend along a major or minor portion of the tobacco column depending on the effect to be achieved and the specification of the heat shrinkable material used and of course the encasement could be applied as a formed tube to a manufactured cigarette or it could be in the form of a band which could be positioned during manufacture or by a smoker at a selected position along the length of the column to extinguish the tobacco at that position.

Figure 5:
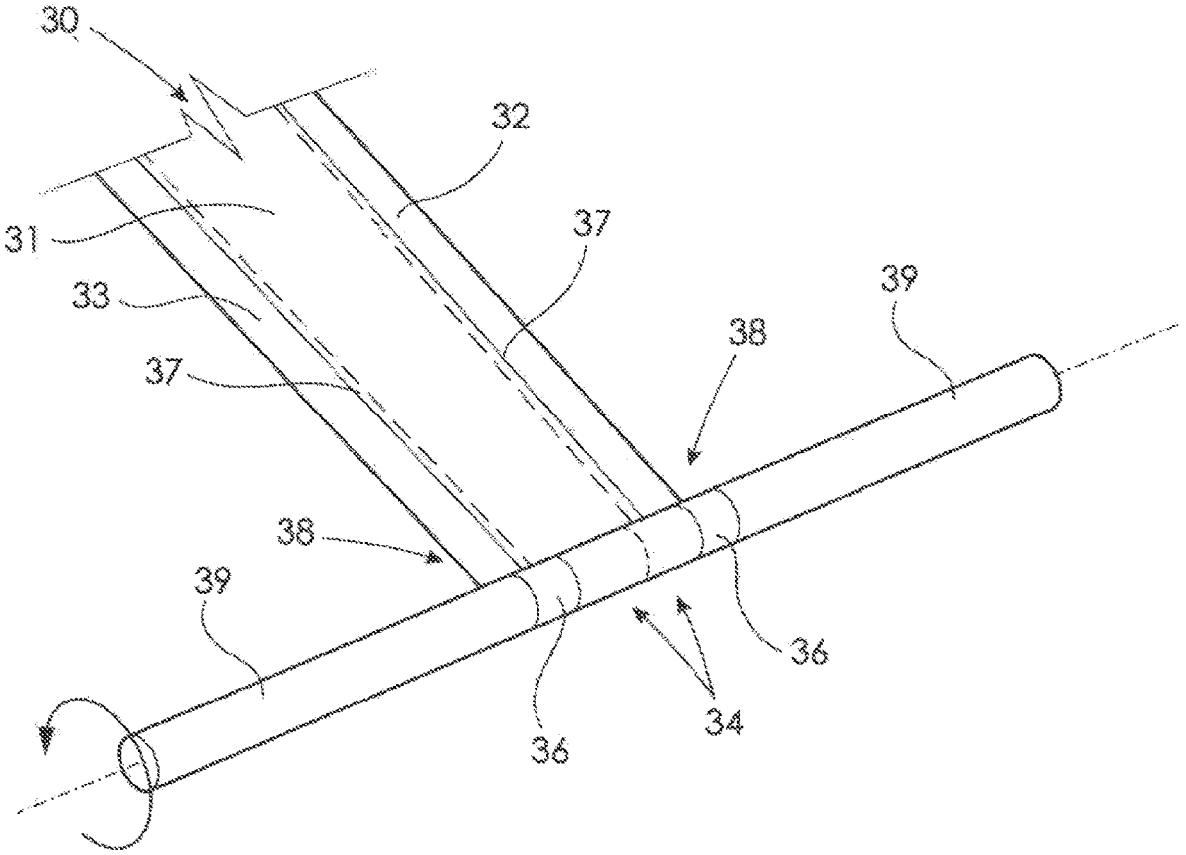
FIG. 5 illustrates an alternate form of tipping paper and method of its installation onto opposed tobacco columns and filters.

In the FIG. 5 embodiment illustrated, a tipping wrap 30 has a central band of tipping paper 31 and opposed side bands 32, 33 of shrinkable wrapping material each arranged with their respective major shrink direction extending longitudinally along the tipping wrap 30. The central band of tipping paper is between 30 mm and 50 mm wide so that it may span a pair of filter assemblies 34 arranged in end to end abutting relationship.

The bands of shrinkable wrapping material 32, 33 are each approximately 10 mm wide and overlap the adjacent edges of the band of tipping paper 31 by about 2 mm and are glued thereto along the overlap zone 37 by a warm set gum. Thus in a manufactured cigarette the formed shrinkable tubes 36 extend about 8 mm along the butt 38 of the tobacco column 39.

According to this method of the invention, opposed pairs of formed tobacco columns 39 and filter assemblies 34 are arranged co-axially in abutting relationship, as illustrated, and the tipping wrap 30 is wound onto the assembled tobacco columns 39 and filter assemblies 34. After wrapping, the formed cigarettes are separated by slitting the wrap 30 between the opposed filter assemblies 34. If desired the tipping wrap could be formed as a broad composite sheet formed of multiple bands of tipping wraps as illustrated in FIG. 5 arranged in side by side relationship across the sheet or otherwise as required to suit the manufacturing process.

It will of course be understood that the above has been given by way of illustrative example only and that all such modifications and variations thereto as would be apparent to persons skilled in the art are deemed to fall within the broad scope and ambit of this invention as is defined in the appended claims.

I claim:

1. A cigarette that includes:

a column assembly including a tobacco column and a co-axially juxtaposed filter, the tobacco column having a butt portion extending axially from the filter, and a composite tipping paper wrap consisting of a band of tipping paper wrapped about the filter and a band of heat shrink material protruding from one edge of the tipping paper, the bands being continuously connected along a common seam to provide a single layer of tipping wrap, wherein the band of heat shrink material is located beyond and does not extend across a junction between the filter and the juxtaposed tobacco column and forms a heat shrink layer encasing the butt portion of the tobacco column.

* * * * *